United States Patent [19]

Beck

[11] Patent Number: 4,967,941

[45] Date of Patent: Nov. 6, 1990

[54] TWIST LOCK ADJUSTABLE METERING CLOSURE CAP

[75] Inventor: James M. Beck, Carol Stream, Ill.

[73] Assignee: Creative Packaging Corp., Wheeling, Ill.

[21] Appl. No.: 337,752

[22] Filed: Apr. 13, 1989

[51] Int. Cl.[5] ..... B67D 3/00

[52] U.S. Cl. ..... 222/521; 222/153; 215/256

[58] Field of Search ..... 222/521, 549, 520, 525, 222/48, 39, 41, 541, 153, 548, 552; 215/311, 313, 220

[56] References Cited

U.S. PATENT DOCUMENTS

| | | | |
|---|---|---|---|
| 1,288,356 | 12/1918 | Woods | 215/521 |
| 2,582,026 | 1/1952 | Friedman | 222/520 |
| 2,762,536 | 9/1956 | Eriksen | 222/519 |
| 3,032,240 | 5/1962 | Dunklee | 222/525 |
| 3,059,821 | 10/1962 | Kubiliunas | 222/520 |
| 3,216,630 | 11/1965 | Stull | 222/499 |
| 3,261,504 | 7/1966 | Sabaka | 222/83 |
| 3,407,967 | 10/1968 | Stull | 222/48 |
| 3,433,394 | 3/1969 | Stull | 222/519 |
| 3,809,299 | 5/1974 | Sand et al. | 222/521 |
| 4,157,768 | 6/1979 | Britt | 222/499 |
| 4,383,623 | 5/1983 | Page, III | 222/521 |
| 4,424,918 | 1/1984 | Stull | 222/153 |
| 4,438,870 | 3/1984 | Stull | 222/48 |
| 4,461,454 | 7/1984 | Vadnais | 251/350 |
| 4,474,314 | 10/1984 | Roggenburg, Jr. | 222/494 |
| 4,705,181 | 11/1987 | Burke et al. | 215/220 |
| 4,754,899 | 7/1988 | Stall | 222/521 |
| 4,805,807 | 2/1989 | Perne et al. | 222/153 |

*Primary Examiner*—H. Grant Skaggs
*Assistant Examiner*—Kenneth Noland
*Attorney, Agent, or Firm*—Silverman, Cass & Singer, Ltd.

[57] ABSTRACT

An adjustable metering twist lock closure cap for dispensing the contents of a container having a central post including a top surface and a substantially cylindrical imperforate perpheral wall having an opening to the top surface for metering the contents to be dispensed. A cap body is reciprocally mounted on the central post and includes an inner periphery which cooperates with the post peripheral wall to form a variable opening between the cap body inner periphery and the post peripheral wall to provide a closure position and a plurality of dispensing positions for dispensing the contents of the container at a plurality of different rates as the cap body is moved on the post away from the closure position. A detent member is also included to provide a positive indication during movement of the cap body relative to the post that the cap body has reached at least one of the closure position and the plurality of dispensing positions.

20 Claims, 1 Drawing Sheet

TWIST LOCK ADJUSTABLE METERING CLOSURE CAP

BACKGROUND OF THE INVENTION

1. Field of the Invention

This invention relates generally to a dispensing closure cap for containers, and more particularly to a twist look adjustable metering dispensing closure cap which has more than one dispensing position and provides positive indications of the cap position during manipulation thereof.

2. Description of the Prior Art

Dispensing closure caps for containers typically are of the push-pull or threaded screw type and generally have only two positions, either fully open or fully closed. In the fully open or dispensing position, the contents of the container can be dispensed at a fixed rate dictated by the open position structure of the closure. In the fully closed position, the contents are sealed within the container and cannot be dispensed therefrom. There are dispensing closures which have a wide variety of metered dispensing openings. Typically, these closures are complex in configuration, and do not lend themselves to be formed economically by molding process, or are too fragile to be used repeatedly without failure, or both.

Additionally, existing closure caps, whether they are the two-position or the variable dispensing type, may not provide an indication to the user of the position of the closure cap. An example of these existing closure caps is shown in co-pending U.S. patent application Ser. No. 169,603 filed Mar. 17, 1988 entitled "Adjustable Metering Closure Cap" (hereinafter called "related application") which is hereby incorporated by reference, both of said applications being in the name of the same Applicant and having the same Assignee.

Thus, in these existing closure caps, in order to determine a given position of the closure cap, the user must either visually inspect or physically test the closure cap. If the closure cap is not in the desired position, the user must readjust the closure cap and visually inspect or test again. This process may need to be repeated several times before the desired dispensing position is reached.

Not only is this process tiresome and inefficient, but it can lead to unexpected volume dispensing which can be damaging, especially if the contents of the container are harmful. For example, if the closure cap is assumed to be fully closed on its container but in fact is slightly open, and the container thereafter is stored or transported, the contents can leak out with detrimental results. Additionally, if the closure cap is assumed to be slightly open for only a small amount of the contents of the container to be dispensed, but is in fact more open than expected, the contents can be displaced too quickly which again may be detrimental.

Furthermore, if a positive indication is not provided that the closure cap is in its fully open or fully closed position, or both, a user frequently attempts to move the closure cap beyond its intended fully open or fully closed position. This is true with either the push-pull type of closure cap or the threaded screw type of cap and can lead to failure of the closure cap or its removal from the container.

Dispensing the contents of a container can also be a problem when the position, and thus the flow rate of the closure cap, is changed inadvertently either before or during dispensing. This change can be caused, for example, by the flow of material through the closure or by bumping the closure against another object.

It therefore is desirable to provide a dispensing closure cap which has more than one dispensing position and provides positive indications of the cap position during manipulation thereof. It also is desirable to provide such a dispensing closure cap which cannot be opened beyond its fully open position, reduces the risk of inadvertent adjustment of the closure, is simple in design, can be readily molded with a minimum number of parts, and is sturdy in construction for repeated use without failure.

SUMMARY OF THE INVENTION

The invention provides a closure cap for dispensing the contents of a container in which the cap has a central post including a top surface and a substantially cylindrical imperforate peripheral wall with an opening to the top surface for metering the contents to be dispensed. A cap body is reciprocally mounted on the central post and includes an inner periphery which cooperates with the post peripheral wall to form a variable opening between the cap body inner periphery and the post peripheral wall to provide a closure position and a plurality of dispensing positions for dispensing the contents of the container at a plurality of different rates as the cap body is moved on the post away from the closure position. A detent member also is included to provide a positive indication during movement between the cap body and the post that the cap body has reached at least one of the closure position and the plurality of dispensing positions.

DESCRIPTION OF THE PREFERRED EMBODIMENTS

Figure 1:
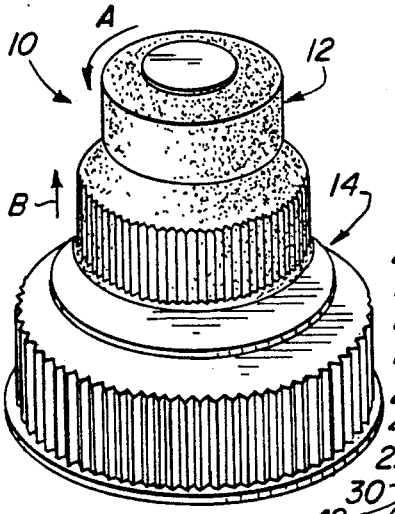
FIG. 1 is a perspective view of one embodiment of a closure cap of the invention illustrated in its fully closed position.
Figure 2:
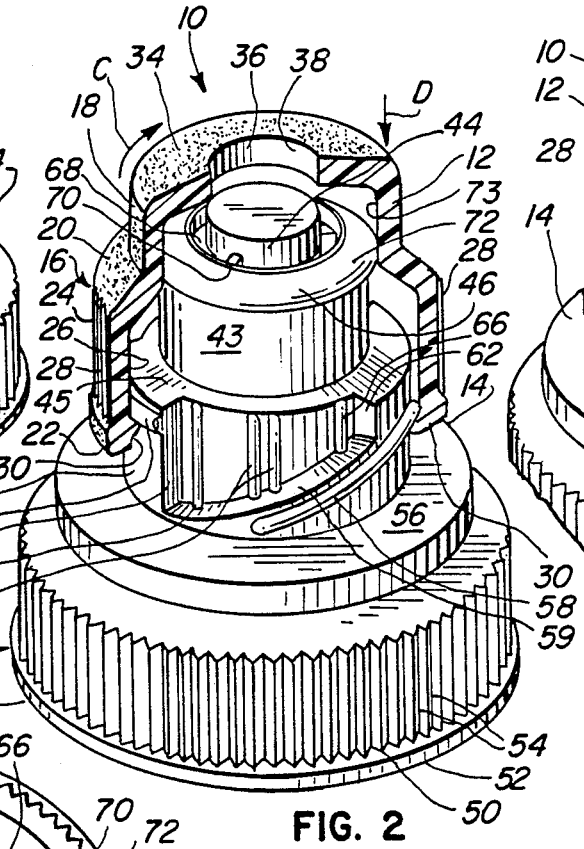
FIG. 2 is an enlarged perspective view of the closure cap of FIG. 1 in its fully open position with the outer cap body thereof partially broken away to illustrate the inner dispensing post of the invention.
Figure 3:
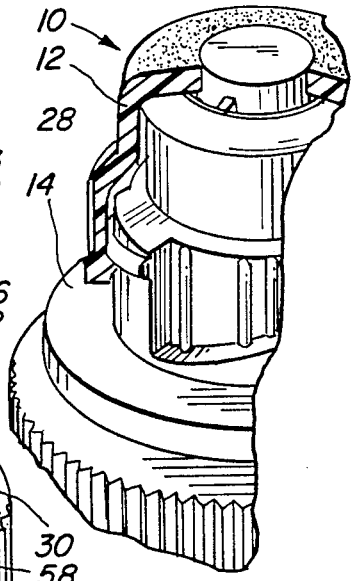
FIG. 3 is an enlarged partial perspective view of the closure cap similar to FIG. 2, with the outer cap body partially broken away to illustrate the closure cap in its fully closed position.

Referring to FIGS. 1–3, an embodiment of a dispensing closure cap of the invention is designated generally by the reference numeral 10. The closure cap 10 includes an outer cap body 12 and an inner metering post or stem 14 whose bottom portion typically is secured to a container (not illustrated).

Figure 4:
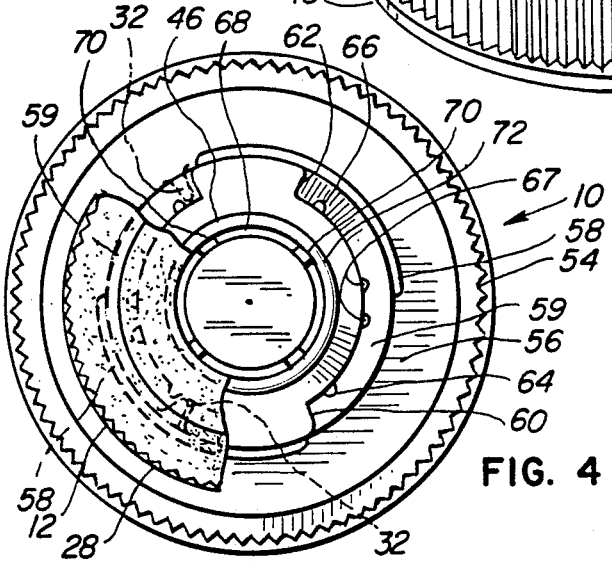
FIG. 4 is a top plan view of the closure cap of FIG. 2 with a portion of the cap body broken away.

Briefly, in operation, the cap body 12 moves along a portion of the length of the post 14 from a fully closed or closure position, illustrated in FIGS. 1 and 3, through a plurality of intermediate dispensing positions to a fully open position illustrated in FIGS. 2 and 4. As the cap body 12 approaches either the fully closed position or the fully open position, positive indications of the position of the cap body 12 are provided by detents which enable a user to feel the cap body 12 click into the fully closed position or the fully open position.

With this design, a user is alerted to the position of the cap body 12 without the need to visually inspect or physically test the closure cap 10. Additionally, the cap body 12 is releasably locked into position which reduces the risk of the cap body 12 being moved out of position inadvertently by a user or by the flow of material or contents of the container through the closure cap 10. It is to be noted that one or more positive indications can also be provided at one or more intermediate dispensing positions of the cap body 12 between the fully closed position and the fully open position.

Preferably, the cap body 12 is threadingly mounted to the post 14 for a rotational screw or twist lock type operation as will be explained in detail hereinafter. The cap body 12, however, can be mounted to the post 14 for a push-pull type operation or a combination of push-pull and screw tYpe operation, such as disclosed in the related application, without departing from the teachings of the present invention.

As FIG. 2 illustrates, the cap body 12 includes bottom and top substantially cylindrical imperforate peripheral wall portions 16 and 18. The wall portions 16 and 18 are joined together by a peripheral shoulder 20 thereby forming a continous surface on the inside of the cap body 12. The bottom wall portion 16 includes a bottom edge 22, an outer side wall 24, and an inner side wall 26. To provide easy manipulation of the cap body 12, the outer side wall 24 of the bottom wall portion 16 can include a plurality of outstanding ribs 28 to form a knurled surface.

In order to threadingly mount the cap body 12 to the post 14, the inner side wall 26 of the cap body 12 includes a plurality of threads 30 which mate threadingly with corresponding threads on the post 14. Additionally, as FIG. 4 illustrates, to provide the desired positive indication of the position of the closure cap 10, the cap body 12 includes an engagement member 32. The engagement member 32 is illustrated in dotted outline on the lower portion of FIG. 4 which depicts the fully open position of the cap body 12. When the cap body 12 is moved to its fully closed position, the engagement member 32 moves to the position illustrated in phantom outline on the upper portion of FIG. 4. Preferably, two sets of threads 30 and two engagement members 32 are utilized and are positioned on opposite sides of the cap body 12. The number of threads 30 and engagement members 32, as well as their positions, can vary. The cooperation between the threads 30, engagement member 32, and the threads on the post 14 will be described in detail hereinafter.

Referring now to FIG. 2, the top wall portion 18 of the cap body 12 includes a top surface 34 having a central aperture 36 which is preferably circular. The aperture 36 has an inner periphery 38 which mates with the post 14 and provides a seal therebetween when the closure cap 10 is in the fully closed position to prevent the contents of the container from passing through the closure cap 10.

As the cap body 12 is moved upwardly along the post 14, the top surface 34, aperture 36, and inner periphery 38 disengage from the top of the post 14 to allow the contents of the container to pass through the aperture 36 and out of the closure cap 10. It is to be noted that the further the cap body 12 moves upwardly along the post 14, the greater the flow rate through the closure cap 10.

The post 14 includes a bottom skirt 40 as well as first, second, and third substantially cylindrical imperforate peripheral wall portions 42, 43, and 44. A first peripheral shoulder portion 45 is provided to connect the first and second wall portions 42 and 43 as well as a second peripheral shoulder portion 46 to connect the second and third wall portions 43 and 44.

The second wall portion 43 preferably has an outer diameter slightly less than the outer diameter of the first wall portion 42. Similarly, the third wall portion 44 preferably has an outer diameter slightly less than the outer diameter of the second wall portion 43. Thus, the outer diameter of the post 14 becomes progressively smaller as the post 14 extends from the bottom skirt 40 to the third wall portion 44.

The bottom skirt 40 includes a bottom edge 48, an outer side wall 50, and an inner side wall 52. To secure the post 14 and thereby the closure cap 10 to a container (not illustrated), the inner side wall 52 of the skirt 40 can include threads (not illustrated) which mate with corresponding threads on the container. In order to assist in securing and removing the post 14 to and from the container, the outer side wall 50 can be knurled by provision of a plurality of outstanding ribs 54.

The first wall portion 42 of the post 14 is integrally formed with a shoulder 56 on the top side of the skirt 40. When the closure cap 10 is in its fully closed position, the bottom edge 22 of the cap body 12 abuts the shoulder 56. As briefly described above, in order to threadingly engage the post 14 to the threads 30 of the cap body 12, the post 14 can include threads 58 positioned on the periphery of the first wall portion 42 which mate with the threads 30.

Preferably, the threads 58 operate in conjunction with a helical ramp 59 positioned on the first wall portion 42. As will be explained below, the ramp 59 cooperates with the threads 58 to assist in providing movement between the cap body 12 and the post 14. It is to be understood, however, that the threads 58 and the ramp 59 can be combined into a single member or the ramp 59 can be eliminated. As FIG. 4 illustrates, two sets of threads 58 and two ramps 59 are utilized and are positioned on opposite sides of the first wall portion 42. It also is to be understood that the number and position of the threads 58 and ramps 59 can vary.

As FIG. 2 illustrates, in order to stop rotation of the cap body 12 with respect to the post 14 to establish the fully closed and fully open positions, the bottom of each ramp 59 can include a stop member 60 while the top of each ramp 59 can include a similar stop member 62. Preferably, the stop members 60 and 62 are formed with the first wall portion 42 and extend upwardly away from the ramp 59 along the first wall portion 42 parallel to the longitudinal axis of the first wall portion 42. The stop members 60 and 62 contact the engagement members 32 of the cap body 12 to prevent further rotation between the cap body 12 and the post 14. Accordingly, the cap body 12 is in its fully closed position when the engagement members 32 abut the stop members 60 and is in its fully open position when the engagement members 32 abut the stop members 62.

To provide the desired positive indication to the user that the closure cap 10 has reached its fully open or fully closed positions, the ramps 59 can include first and second detent or rib members 64 and 66. Preferably, the detent members 64 and 66 extend outwardly from the first wall portion 42 and upwardly away from the ramp 59 along the first wall portion 42 parallel to the longitudinal axis of the first wall portion 42. Two detent members 64 and 66 are preferably utilized, one set per ramp 59, but the number can vary.

Alternatively, if the ramp 59 is combined with the threads 58 or is eliminated, the threads 58 can include the detent members 64 and 66. In this case, the detent members 64 and 66 can span the width of the threads 58 or can be slight protrusions on the threads 58 so long as they function as described.

The first detent members 64 are positioned proximate to the stop members 60 while the second detent members 66 are positioned proximate to the stop members 62. Thus, upon rotation of the cap body 12, the engagement members 32 of the cap body 12 ride along the ramps 59. Upon contact with the detents 64 or 66, the cap body 12 can be further rotated so that the engagement members 32 ride over the detents 64 or 66 to abut the stop members 60 or 62 respectively to obtain the fully closed and fully open positions.

It is to be noted that as the engagement members 32 ride along the ramps 59, the cap body 12 is in turn raised and lowered with respect to the post 14. This movement places the closure cap 10 alternatively in its fully open and closed positions, as well as a variety of intermediate dispensing positions. At the same time, the threads 58 cooperate with the ramps 59 to assist in the movement of the cap body 12 to its fully open position. As the cap body 12 is moved from its fully open position to its fully closed position, the threads 58 pull the cap body 12 downward toward the shoulder 56 of the post 14.

Additionally, when the engagement members 32 ride over the detents 64 or 66, an audible "click" is heard and the user can feel the engagement members riding over the detents because the action is transmitted through the cap body 12. Thus, a user is informed of the position of the cap body 12 without having to visually inspect or physically test it. Also, the cap body 12 is releasably locked in the desired position to reduce the risk of the cap body 12 being inadvertently moved out of such locked position.

As FIG. 2 illustrates, one or more detent members 67 can also be placed along the ramp 59 and the first wall portion 42 at any intermediate position between the detents 64 and 66. Thus, a desired "feel" or "click" indication can be provided to a user that the cap body 12 is in such an intermediate position. Also, if two detents 67 are utilized and are placed sufficiently close together, the engagement members 32 can seat between the detents 67 and be releasably locked in that intermediate position.

As FIGS. 2 and 4 illustrate, in order to enable the contents of the container to flow through the post 14 and in turn through the aperture 36 of the cap body 12, the shoulder 46 between the second and third wall portions 43 and 44 can include a plurality of apertures 68 separated by a plurality of ribs 70. Alternatively, the shoulder portion 46 can be formed as a solid member with one or more apertures 68. Thus, when the cap body 12 of the closure cap 10 is in one of its open positions, the contents can flow from the container, through the post 14, the apertures 68, and the aperture 36.

Furthermore, to aid in preventing the contents of the container from leaking down onto the first and second wall portions 42 and 43, the shoulder portion 46 can include a ring 72 which protrudes slightly outward from the top of the second wall portion 43. The ring 72 bears against an interior surface 73 of the top wall portion 18 of the cap body 12 and forms a seal therebetween. The ring 72 also bears against the shoulder 20 between the bottom wall portion 16 and top wall portion 18 of the cap body 12 when the cap body is in the fully open position to aid in preventing removal of the cap body 12 from the post 14. If the cap body 12, however, is pulled upwardly away from the post 14 with extreme force, the ring 72 can disengage from the top wall portion 18 to separate the cap body 12 from the post 14.

The operation of the closure cap 10 will now be described in detail beginning with the closure cap 10 in its fully closed position as illustrated in FIGS. 1 and 3. In this position, the engagement members 32 of the cap body 12 are in contact with the stop members 60 on the bottom of the ramps 59. The inner periphery 38 of the aperture 36 of the cap body 12 is in sealing engagement with the outer periphery of the third wall portion 44 of the post 14.

Upon counterclockwise rotation of the cap body 12 in the direction of arrow "A", the engagement members 32 engage the bottom detent members or ribs 64. Further rotation of the cap body 12 enables the engagement members 32 to ride over and clear the detent members 64 and to engage the ramps 59.

As the cap body 12 is rotated further, the engagement members 32 ride upwardly along the ramps 59, thereby raising the cap body 12 with respect to the post 14 in the upward direction of arrow "B". During this motion, the threads 58 assist in keeping the engagement members 32 in contact with the ramps 59 and help provide the upward movement of the cap body 12. At the same time, the inner periphery 38 of the aperture 36 rises slightly above the third wall portion 44 of the post 14. If rotation of the cap body 12 is stoped at this position, the contents within the container can now pass through the apertures 68 in the shoulder 46 of the post 14 and out of the cap body 12 through the aperture 36 at a reduced rate. Continued rotation of the cap body 12 provides for a larger opening between the inner periphery 38 of the aperture 36 and the third wall portion 44, thereby allowing the contents to be dispensed at a greater rate.

When the contents are being dispensed through the closure cap 10, the contents or material may accumulate in the area between the cap body 12 and the third wall portion 44 of the post 14. As described above, however, the seal between the ring 72 of the post 14 and the interior surface 73 of the top wall portion 18 of the cap body 12 assists in preventing the material from leaking down onto the first and second wall portions 42 and 43. When the cap body 12 moves along the post 14, the ring 72 likewise moves along the interior surface 73 of the top wall portion 18. Thus, the seal remains intact during the entire movement of the cap body 12. Also, when the cap body 12 is moved to its fully closed position, material in the area between the cap body 12 and the third wall portion 44 either returns to the container or exits the closure cap 10 through the aperture 36.

As the cap body 12 is rotated near its fully open position, the engagement members 32 contact the upper detent members 66. Further rotation of the cap body 12 enables the engagement members 32 to ride over and clear the detent members 66 and to engage the stop members 62. Continued rotation of the cap body 12 is not possible due to the contact between the engagement members 32 and the stop members 62.

To return the closure cap 10 to its fully closed position, the cap body 12 is rotated in the reverse or clockwise direction of arrow "C" in FIG. 2. The cooperation of parts between the cap body 12 and the post 14 is reversed thereby moving the cap body 12 downwardly in the direction of arrow "D" until the engagement members 32 stop against the bottom stop members 60.

If intermediate detent members 67 are utilized, upon rotation of the cap body 12 the engagement members 32 will contact the detent members 67. Upon continued rotation of the cap body 12, the engagement members 32 will ride over the detent members 67 similar to their action with respect to the detent members 64 and 66.

Figure 5:
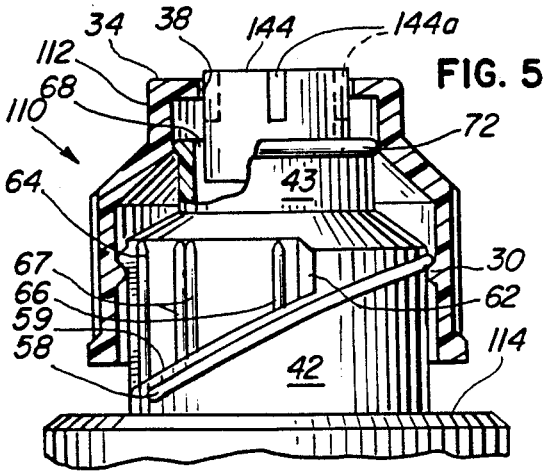
FIG. 5 is a partial side sectional view of an alternate embodiment of the closure cap of the invention shown in an open position.
Figure 6:
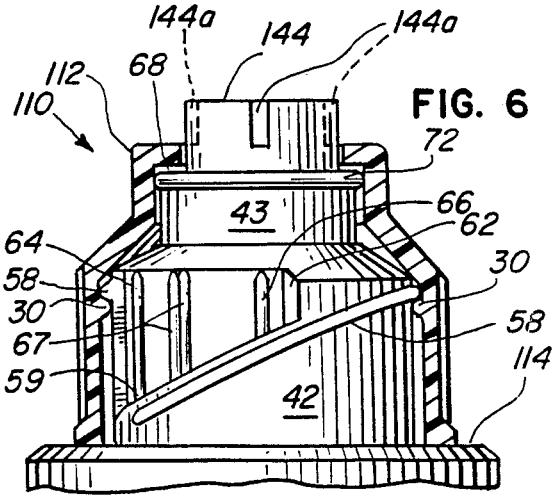
FIG. 6 is a partial side sectional view of the closure cap of FIG. 5 shown in its fully closed position.

FIGS. 5 and 6 illustrate an alternate embodiment of the invention where common elements are referred to by the same numerals. In this embodiment, the closure cap 110 includes an outer cap body 112 and an inner metering post or stem 114 whose bottom portion likewise typically is secured to a container (not illustrated).

As in the embodiment of FIGS. 1–4, in operation, the cap body 112 moves along a portion of the length of the post 114 from a fully closed position, illustrated in FIG. 6, to a fully open position, illustrated in FIG. 5. In this embodiment, however, the third wall portion 144 of the post 114 is enlarged lengthwise and includes one or more slots **144*a* of the same or variable lengths to provide reduced metered dispensing openings as the cap body 112 is moved to the fully open position of FIG. 5. Additionally, to provide a full open position similar to the FIG. 1–4 embodiment, the cap body 112 can be designed so that its fully open position is established with the top surface 34, aperture 36, and inner periphery 38 completely above the top of the third wall portion 144**.

In the fully closed position illustrated in FIG. 6, the top surface 34 of the cap body 112 abuts the outer periphery of the third wall portion 144 slightly below the slots **144*a*. Accordingly, the contents within the container are prevented from being dispensed since they cannot reach the slots 144*a* from the apertures 68**.

In operation, when the cap body 112 is in any of its open positions, the contents flow through the apertures 68 in the second wall portion 43, into the bottom of the slots **144*a*, and exit the third wall portion 144 and closure cap 110 through the top of the slots 144*a*. The operation of the remaining elements is virtually the same as in the FIG. 1–4** embodiment.

As mentioned previously, the cap body 12 can be mounted to the post 14 for a push-pull type of operation or a combination of push-pull and screw type operation. With a push-pull design, detent members (not illustrated) can be placed proximate the top and bottom edges of the first wall portion 42 or at any other position along the post 14. Thus, when the cap body 12 is pushed to its fully closed position where its bottom edge 22 abuts the shoulder 56 on the post 14, it must first pass over the bottom detent member thereby providing the desired positive indication. Likewise, upon pulling the cap body 12 to its fully open position where the ring 72 abuts the shoulder 20 of the cap body 12, the cap body 12 must pass over the upper detent member thereby providing the desired positive indication. With a combination push-pull and screw type design, detent members 64 and 66 can be utilized as described in the embodiments of FIGS. 1–4 and 5–6.

Modifications and variations of the present invention are possible in light of the above teachings. A specific dimension, material, or construction is not required so long as the assembled device is able to function as herein described. It is therefore to be understood that within the scope of the appended claims, the invention may be practiced otherwise than as specifically described.

What is claimed and desired to be secured by letters patent of the United States is:

1. A closure cap for dispensing contents of a container, comprising:

a central post having a top surface and a substantially cylindrical imperforate peripheral wall with an opening to said top surface for metering the contents to be dispensed;

a cap body reciprocally mounted on said central post and having an inner periphery which cooperates with said post peripheral wall to form a variable opening between said cap body inner periphery and said post peripheral wall to provide a closure position, a fully open position, and a plurality of dispensing positions for dispensing the contents of said container at a plurality of different rates as said cap body is moved on said post away from said closure position toward said fully open position; and cooperative detent means between said post and cap body for providing a positive indication that can be felt by a user during movement of said cap body which indicates when said cap body has reached said closure position or said fully open position, respectively.

2. The closure as defined in claim 1 wherein said cap body is reciprocally mounted on said central post by threads and upon rotating between said cap body and said central post said cap body is moved between said closure position through a plurality of dispensing positions to said fully open position.

3. The closure as defined in claim 2 wherein opposite ends of said threads of at least one of said cap body and said central post include a stop member and the threads of at least one of said cap body and said central post opposite said stop members include an engagement member which, upon rotation between said cap body and said central post, engages said stop members at opposite ends of said threads to prohibit rotation of said cap body beyond said closure position and said fully open position.

4. The closure as defined in claim 3 wherein said detent means include at least one rib member positioned within each opposite end of said threads proximate said stop members, said engagement member being capable of contacting and riding over said rib members to engage said stop members to provide said positive indication that said cap body has reached said closure position and said fully open position.

5. The closure as defined in claim 4 wherein said detent means further include at least one additional rib member positioned within the threads of at least one of said cap body and said central post, intermediate said rib members that are positioned proximate said stop members, to provide a positive indication that said cap body has reached at least one intermediate position between said closure position and said fully open position.

6. The closure as defined in claim 5 wherein at least one of said cap body and said central post include a helical ramp member, said ramp member including said stop members and said detent members and cooperating with said engagement member and said threads to prohibit rotation of said cap body beyond said closure position and fully open position and provide said positive indication.

7. A closure cap for dispensing contents of a container, comprising:

a central upstanding post having a first substantially cylindrical imperforate peripheral wall portion, a second reduce diameter substantially cylindrical imperforate peripheral wall portion positioned on top of said first wall portion and having a top surface, and a peripheral shoulder portion connecting said first and second wall portions together, said shoulder portion including at least one opening to said post top surface for metering the contents to be dispensed.

a cap body reciprocally mounted on said central post and having an aperture whose inner periphery cooperates with said peripheral wall of said second wall portion to provide a closure position, a fully open position, and a plurality of dispensing positions for dispensing the contents at a plurality of different rates as said cap body is moved on said post away from said closure position toward said full open position; and cooperative detent means between said post and cap body for providing a positive indication that can be felt by a user during movement of said cap body which indicates when said cap body has reached said closure position or said fully open position, respectively.

8. The closure as defined in claim 7 wherein said cap body is reciprocally mounted on said central post by threads and upon rotation of said cap body relative to said central post said cap body is moved between said closure position, through a plurality of dispensing positions to a fully open position.

9. The closure as defined in claim 8 wherein said plurality of dispensing positions and said fully open position are provided by said inner periphery of said aperture of said cap body clearing said top surface of said second wall portion.

10. The closure as defined in claim 8 wherein said second wall portion includes at least one slot formed substantially along the length of an upper portion thereof opening to said post top surface for metering the contents to be dispensed, said inner periphery of said aperture of said cap body cooperating with said peripheral wall of said second wall portion and said slot to provide said closure position with said slot being above said inner periphery, said fully open position by said inner periphery clearing said top surface of said post, and said plurality of dispensing positions provided between said inner periphery and said slot.

11. The closure as defined in claim 8 wherein said threads are positioned on said first wall portion of said central post, the opposite ends of said threads including a stop member and the threads of said cap body including an engagement member which, upon rotation of said cap body relative to said central post, engages said stop member at opposite ends of said threads to prohibit rotation of said cap body beyond said closure position and said fully open position.

12. The closure as defined in claim 11 wherein said detent means include at least one rib member positioned within each opposite end of said threads of said first wall portion proximate said stop members, said engagement member being capable of contacting and riding over said rib members to engage said stop members to provide said positive indication that said cap body has reached said closure position or said fully open position.

13. The closure as defined in claim 12 wherein said detent means further include at least one additional rib member positioned within the threads of said central post, intermediate said rib members that are positioned proximate said stop members, to provide a positive indication that said cap body has reached at least one intermediate position between said closure position and said fully open position.

14. The closure as defined in claim 13 wherein said first wall portion of said central post includes a helical ramp member, said ramp member including said stop members and said detent members and cooperating with said engagement member and said threads to prohibit rotation of said cap body beyond said fully closed and fully open positions and provide said positive indications.

15. The closure as defined in claim 1 wherein said cooperative detent means provide a positive indication that can be felt by a user during movement of said cap body which indicates that said cap body has reached at least one of said plurality of dispensing positions.

16. The closure as defined in claim 7 wherein said cooperative detent means provide a positive indication that can be felt by a user during movement of said cap body which indicates that said cap body has reached at least one of said plurality of dispensing positions.

17. A closure cap for dispensing the contents of a container at variable rates comprising:

a central upstanding post having first, second, and third substantially cylindrical imperforate peripheral wall portions positioned on top of one another, the outside diameters of each wall portion being progressively smaller from said first wall portion to said third wall portion, said third wall portion having a top surface, said post further including a first peripheral shoulder portion connecting said first and second wall portions together and a second peripheral shoulder portion connecting said second and third wall portions together, said second shoulder portion including at least one opening to said post top surface for metering the contents to be dispensed;

a cap body threadingly mounted on said central post and having an aperture through a top surface thereof, an inner periphery of said aperture cooperating with the outer periphery of said third wall portion to provide a closure position and a plurality of dispensing positions for dispensing the contents at a plurality of different rates as said cap body is moved on said central post away from said closure position;

at least one engagement member positioned on an interior surface of said cap body;

at least one helical ramp member positioned on the outer periphery of said second wall portion of said central post, said ramp member including a positive stop member at opposite ends thereof and at least two rib members one each positioned proximate each stop member, said engagement member cooperating with said ramp member and said stop members and said rib members to provide movement between said central post and said cap body, to provide a positive stop at both said closure position and said fully open position of said closure, and to provide a positive indication that said cap body has been rotated between said closure position and said fully open position.

18. The closure as defined in claim 17 wherein said ramp member includes at least one additional rib member positioned intermediate said at least two rib members to provide a positive indication that said cap body has reached at least one intermediate position between said closure position and said fully open position.

19. The closure as defined in claim 17 wherein said third wall portion includes at least one slot formed substantially along the length of an upper portion thereof opening to said post top surface for metering the contents to be dispensed, said inner periphery of said aperture of said cap body cooperating with said peripheral wall of said third wall portion and said slot to provide said closure position with said slot being above said inner periphery, said fully open position by said inner periphery clearing said top surface of said post, and said plurality of dispensing positions provided between said inner periphery and said slot.

20. The closure as defined in claim 19 wherein said ramp member includes at least one additional rib member positioned intermediate said at least two rib members to provide a positive indication that said cap body has reached at least one intermediate position between said closure position and said fully open position.

* * * * *